US009102896B2

(12) United States Patent
Ushioda et al.

(10) Patent No.: US 9,102,896 B2
(45) Date of Patent: Aug. 11, 2015

(54) FUEL ECONOMICAL LUBRICATING OIL COMPOSITION FOR INTERNAL COMBUSTION ENGINES

(71) Applicants: Nobuo Ushioda, Omaesaki (JP); Tsuyoshi Miyamoto, Omaezaki (JP); Yasuhiro Ogasawara, Omaezaki (JP)

(72) Inventors: Nobuo Ushioda, Omaesaki (JP); Tsuyoshi Miyamoto, Omaezaki (JP); Yasuhiro Ogasawara, Omaezaki (JP)

(73) Assignee: Chevron Japan LTD., San Ramon, CA (US)

( * ) Notice: Subject to any disclaimer, the term of this patent is extended or adjusted under 35 U.S.C. 154(b) by 0 days.

(21) Appl. No.: 13/716,349

(22) Filed: Dec. 17, 2012

(65) Prior Publication Data

US 2014/0171349 A1 Jun. 19, 2014

(51) Int. Cl.

| | |
|---|---|
| ***C10M 129/48*** | (2006.01) |
| ***C10M 129/26*** | (2006.01) |
| ***C10M 105/22*** | (2006.01) |
| ***C10M 105/30*** | (2006.01) |
| ***C10M 159/24*** | (2006.01) |
| ***C10M 163/00*** | (2006.01) |

(52) U.S. Cl.

CPC ..... *C10M 163/00* (2013.01); *C10M 2203/1025* (2013.01); *C10M 2207/262* (2013.01); *C10M 2209/084* (2013.01); *C10M 2215/064* (2013.01); *C10M 2215/28* (2013.01); *C10M 2219/046* (2013.01); *C10M 2219/068* (2013.01); *C10M 2223/045* (2013.01); *C10M 2227/066* (2013.01); *C10N 2210/02* (2013.01); *C10N 2230/06* (2013.01); *C10N 2240/10* (2013.01)

(58) Field of Classification Search

CPC ..... C10M 2219/046; C10M 2207/144; C10M 2207/125; C10M 2215/24; C10M 2215/28; C10M 2207/262; C10M 2207/628; C10M 2207/28; C10N 2230/04; C10N 2210/02

USPC ..... 508/287, 391, 460, 478, 479, 502, 517, 508/518, 523, 87

See application file for complete search history.

(56) References Cited

U.S. PATENT DOCUMENTS

| | | | | |
|---|---|---|---|---|
| 3,929,650 | A | 12/1975 | King et al. | |
| 4,098,790 | A | 7/1978 | Bach | |
| 6,103,672 | A * | 8/2000 | Dunn et al. | 508/185 |
| 6,140,282 | A | 10/2000 | Cartwright et al. | |
| 6,521,571 | B1 * | 2/2003 | Garner et al. | 508/359 |
| 2002/0098992 | A1 * | 7/2002 | Dunn et al. | 508/460 |
| 2005/0130855 | A1 * | 6/2005 | Yagishita | 508/440 |
| 2005/0137100 | A1 * | 6/2005 | Le Coent et al. | 508/518 |
| 2006/0270567 | A1 * | 11/2006 | Kurihara et al. | 508/192 |
| 2007/0027057 | A1 * | 2/2007 | Le Coent et al. | 510/505 |
| 2008/0167207 | A1 | 7/2008 | Nagamatsu | |
| 2008/0248981 | A1 | 10/2008 | Matsui | |
| 2010/0062958 | A1 * | 3/2010 | Bertram et al. | 508/460 |
| 2011/0021393 | A1 | 1/2011 | Kasai | |
| 2011/0077182 | A1 * | 3/2011 | Jukes | 508/460 |
| 2011/0207639 | A1 | 8/2011 | Carey et al. | |

FOREIGN PATENT DOCUMENTS

| | | | |
|---|---|---|---|
| EP | 1561799 | A1 * | 8/2005 |
| JP | 5-163497 | A | 6/1993 |
| JP | 6-336592 | A | 12/1994 |
| JP | 8-302378 | A | 11/1996 |
| JP | 11-29784 | | 2/1999 |
| JP | 2005263861 | A * | 9/2005 |
| JP | 2010-047667 | A | 3/2010 |
| JP | 2011-132404 | A | 7/2011 |
| WO | 9428095 | A1 | 12/1994 |

OTHER PUBLICATIONS

Chinese Office Action issued in counterpart Chinese Patent Application No. 2012600 768. dated Apr. 3, 2015.

* cited by examiner

*Primary Examiner* — Pamela H Weiss

(57) ABSTRACT

A fuel economical lubricating oil composition for internal combustion engines comprises a base oil and an additive composition comprising an overbased metal-containing detergent and a molybdenum-containing friction modifier, in which the overbased metal-containing detergent comprises calcium salicylate having an alkyl group having an average carbon atom number of 14-18, at least 60 mol. % of the alkyl group having a carbon atom number of 14-18, and calcium sulfonate having an alkyl group having an average carbon atom number of 20-24, at least 60 mol. % of the alkyl group having a carbon atom number of 20-24, and/or calcium salicylate having an alkyl group having an average carbon atom number of 20-28, at least 60 mol. % of the alkyl group having a carbon atom number of 20-28.

15 Claims, No Drawings

FUEL ECONOMICAL LUBRICATING OIL COMPOSITION FOR INTERNAL COMBUSTION ENGINES

This application claims priority to Japanese Patent Application number JP2011-286254 which was filed in Japan on Dec. 27, 2011.

FIELD OF INVENTION

The present invention relates to a lubricating oil composition which is favorably employable for lubricating internal combustion engines such as diesel engines, gasoline engines, and gas engines mounted on land-travelling vehicles, with high fuel economy.

BACKGROUND OF INVENTION

Recently, the requirements for improvement of fuel economy to land-travelling vehicles on which a gasoline engine or a diesel engine is mounted, such as automotives, have continued with increased severity. It has been known that the improvement of fuel economy is most effectively made by reduction of weight of the vehicle on which an internal combustion engine is mounted. It also has been known that the improvement of fuel economy can be attained by appropriately selecting the lubricating oil composition employed for lubricating the internal combustion engine mounted on the vehicle.

For the reason described above, until now, the companies engaged for developing lubricating oil compositions as well as the companies engaged for developing lubricating oil additives have intensively made studies for providing lubricating oil compositions which show improved fuel economy.

The improvement of fuel economy provided by the lubricating oil composition generally can be attained by reduction of torque of rotation of the engine parts which is caused by the use of a lubricating oil composition providing reduction of friction to the sliding parts of the engine. The extent of reduction of friction provided by the lubricating oil composition mainly depends on the viscosity of the lubricating oil composition and selection of additives, mainly the selection of the friction modifier. For instance, if the lubricating oil composition is formulated with a base oil of low viscosity, the friction-reducing effect provided by the lubricating oil composition increases. However, the use of the base oil of low viscosity likely results in unfavorable phenomenon such as increase of oil consumption occurring during operation of the engine. Therefore, the improvement of fuel economy by the use of a lubricating oil composition employing a base oil of low viscosity has its limit. For this reason, intensive studies have been made on employment of appropriate lubricating oil additives, whereby improving the fuel economy provided by the lubricating oil composition. Until now, a variety of inventions made from these studies have been disclosed in a number of patent applications.

Patent publication 1 (JP 5-163497 A) discloses an engine oil composition showing low friction property, which comprises a base oil and an additive composition comprising a borated alkenylsuccinimide, an alkaline earth metal salicylate and molybdenum dithiophosphate and/or molybdenum dithiocarbamate.

Patent publication 2 (JP 6-336592 A) describes that a lubricating oil composition comprising zinc dialkyldithiophosphate being mainly composed of a zinc dialkyldithiophosphate having a secondary alkyl group, a metal-containing detergent composition comprising calcium sulfonate (e.g., TBN 200-300) and calcium salicylate (e.g., TBN 10-100), and molybdenum dithiocarbamate having a $C_{8-23}$ hydrocarbyl group shows increased low wear-producing property and increased low friction property.

Patent publication 3 (JP 8-302378 A) describes that an engine oil composition comprising a base oil having a specific kinematic viscosity and specific total aromatic content, an alkaline earth metal salicylate, zinc dialkyldithiophosphate, a succinimide ashless dispersant having a polybutenyl group having a molecular weight of 900-3500, a phenol type-ashless oxidation inhibitor, and molybdenum dithiocarbamate shows improved fuel economy.

SUMMARY OF INVENTION

Accordingly, it is the object of the invention to provide an improvement of a lubricating oil composition containing a molybdenum-containing friction modifier which is well known to give an excellent friction-reducing property as well as to improve the fuel economy. The improved lubricating oil composition of the invention shows further increased fuel economy.

The inventors of the present invention have studied on the synergistic effects for improvement of fuel economy provided by combinations of the molybdenum-containing friction modifier and various lubricating oil additives. As a result of the studies, the inventors have found that a lubricating oil composition containing a combination of the molybdenum-containing friction modifier and an overbased metal-containing detergent composition comprising calcium salicylate having an alkyl group having an average carbon atom number of 14-18 (at least 60 mol. % of the alkyl group has a carbon atom number of 14-18), and calcium sulfonate having an alkyl group having an average carbon atom number of 20-24 (at least 60 mol. % of the alkyl group has a carbon atom number of 20-24), and/or calcium salicylate having an alkyl group having an average carbon atom number of 20-28 (at least 60 mol. % of the alkyl group has a carbon atom number of 20-28) shows surprisingly improved fuel economy. The invention described herein has been made on this finding.

Accordingly, the present invention provides a lubricating oil composition for internal combustion engines which comprises a major amount of an oil of lubricating viscosity and a minor amount of an additive composition comprising an overbased metal-containing detergent composition and a molybdenum-containing friction modifier, wherein the overbased metal-containing detergent composition comprises calcium salicylate having an alkyl group having an average carbon atom number in the range of 14 to 18, at least 60 mol. % (preferably, at least 70 mol. %) of said alkyl group having a carbon atom number in the range of 14 to 18; and at least one of the following calcium-containing detergents:

calcium sulfonate having an alkyl group having an average carbon atom number in the range of 20 to 24, at least 60 mol. % (preferably, at least 70 mol. %) of said alkyl group having a carbon atom number in the range of 20 to 24, and calcium salicylate having an alkyl group having an average carbon atom number in the range of 20 to 28, at least 60 mol. % (preferably, at least 70 mol. %) of said alkyl group having a carbon atom number in the range of 20 to 28.

The lubricating oil composition of the invention contains the base oil (i.e., oil of lubricating viscosity) generally in the amount of 70 wt. % or more, preferably in the amount of 80 wt. % or more, of the lubricating oil composition.

DETAILED DESCRIPTION OF INVENTION

Preferred embodiments of the invention are described below.

(1) The molybdenum-containing friction modifier comprises molybdenum dithiocarbamate.

(2) The calcium salicylate having an alkyl group having an average carbon atom number in the range of 14 to 18, at least 60 mol. % of said alkyl group having a carbon atom number in the range of 14 to 18 has an overbased degree of 1 to 4, and the calcium sulfonate having an alkyl group having an average carbon atom number in the range of 20 to 24, at least 60 mol. % of said alkyl group having a carbon atom number in the range of 20 to 24 and the calcium salicylate having an alkyl group having an average carbon atom number in the range of 20 to 28, at least 60 mol. % of said alkyl group having a carbon atom number in the range of 20 to 28 have an overbased degree of 6 to 24.

(3) A ratio of the overbased degree of the calcium sulfonate having an alkyl group having an average carbon atom number in the range of 20 to 24, at least 60 mol. % of said alkyl group having a carbon atom number in the range of 20 to 24 and the calcium salicylate having an alkyl group having an average carbon atom number in the range of 20 to 28, at least 60 mol. % of said alkyl group having a carbon atom number in the range of 20 to 28 to the calcium salicylate having an alkyl group having an average carbon atom number in the range of 14 to 18, at least 60 mol. % of said alkyl group having a carbon atom number in the range of 14 to 18 is in the range of 2 to 12.

(4) The overbased metal-containing detergent composition comprises the calcium salicylate having an alkyl group having an average carbon atom number in the range of 14 to 18, at least 60 mol. % of said alkyl group having a carbon atom number in the range of 14 to 18 and the calcium sulfonate having an alkyl group having an average carbon atom number in the range of 20 to 24, at least 60 mol. % of said alkyl group having a carbon atom number in the range of 20 to 24.

(5) The overbased metal-containing detergent composition comprises the calcium salicylate having an alkyl group having an average carbon atom number in the range of 14 to 18, at least 60 mol. % of said alkyl group having a carbon atom number in the range of 14 to 18 and the calcium salicylate having an alkyl group having an average carbon atom number in the range of 20 to 28, at least 60 mol. % of said alkyl group having a carbon atom number in the range of 20 to 28.

(6) The lubricating oil composition comprises the molybdenum-containing friction modifier in an amount of 0.01 to 0.15 wt. % in terms of molybdenum content in the lubricating oil composition.

(7) The lubricating oil composition comprises each of the calcium salicylate having an alkyl group having an average carbon atom number in the range of 14 to 18, at least 60 mol. % of said alkyl group having a carbon atom number in the range of 14 to 18 and at least one of the following calcium-containing detergents: calcium sulfonate having an alkyl group having an average carbon atom number in the range of 20 to 24, at least 60 mol. % of said alkyl group having a carbon atom number in the range of 20 to 24 and calcium salicylate having an alkyl group having an average carbon atom number in the range of 20 to 28, at least 60 mol. % of said alkyl group having a carbon atom number in the range of 24 to 28 in an amount of 0.01 to 0.4 wt. % in terms of calcium content in the lubricating oil composition.

(8) The lubricating oil composition further comprises a low overbased calcium sulfonate having an alkyl group having an average carbon atom number in the range of 14 to 24, at least 60 mol. % of said alkyl group having a carbon atom number in the range of 14 to 24 and having an overbased degree of 0.1 to 2.

(9) The lubricating oil composition further comprises a lubricating oil additive selected from the group consisting of a nitrogen-containing ashless dispersant, a zinc phosphate oxidation inhibitor, a zinc phosphate anti-wear agent, a phenolic oxidation inhibitor, and an amine oxidation inhibitor.

(10) Each of the zinc phosphate oxidation inhibitor and zinc phosphate anti-wear agent comprises a mixture of zinc di(primary alkyl)dithiophosphate and zinc di(secondary alkyl)dithiophosphate in a weight ratio of 1/9 to 9/1.

(11) The nitrogen-containing ashless dispersant is a succinimide dispersant which may be post-treated with ethylene carbonate or a borate compound.

(12) The lubricating oil composition further comprises a molybdenum complex of succinimide which may contain sulfur.

(13) The oil of lubricating viscosity has a viscosity index of 120 to 160.

(14) The lubricating oil composition satisfies SAE viscosity grade of 0W20.

The lubricating oil composition of the invention provides increased high fuel economy to internal combustion engines such as gasoline engines and diesel engines. Therefore, vehicles on which these internal combustion engines are mounted show improved fuel economy.

The base oil and additives employable for the preparation of the lubricating oil composition of the invention are described below in more detail.

Base Oil

The base oil (i.e., oil of lubricating viscosity) generally is a mineral oil or a synthetic oil showing a kinematic viscosity of 2 to 50 $mm^2/s$ at 100° C. There are no specific limitations on the natures and other properties of the mineral oil and synthetic oil. However, the sulfur content of the base oil should be 0.1 wt. % or less. The sulfur content preferably is 0.03 wt. % or less, and more preferably is 0.005 wt. % or less.

The mineral oil preferably is an oil which is obtained by processing a lubricating oil distillate of a mineral oil by solvent refining, hydrogenation, or their combination. Particularly preferred is a highly hydrogenated refined oil (corresponding to a hydrocracked oil, typically has a viscosity index of 120 to 160, an aromatic component content of 5 wt. % or less, a nitrogen content of 50 wt·ppm or less, and a sulfur content of 50 wt. ppm or less). Particularly preferred is a high viscosity index base oil, for instance, a base oil having a viscosity index of 140 to 160 which is obtained by hydroisomerization of slack wax or GTL wax (Gas-To-Liquid).

Examples of the synthetic oils (synthetic lubricating base oils) include poly-1-olefin such as a polymerized compound of -olefin having 3 to 12 carbon atoms; a dialkyl ester of a di-basic acid such as sebacic acid, azelaic acid or adipic acid and an alcohol having 4 to 18 carbon atoms, typically dioctyl sebacate; a polyol ester which is an ester of 1,1,1-trimethylolpropane or pentaerythritol and a mono-basic acid having 3 to 18 carbon atoms; and alkylbenzene having an alkyl group of 9 to 40 carbon atoms. The synthetic oil generally contains essentially no sulfur, shows good stability to oxidation and good heat resistance, and gives less residual carbon and soot when it is burned. Therefore, the synthetic oil is preferably employed for the lubricating oil composition of the invention. Particularly preferred is poly-1-olefin, from the viewpoint of the object of the invention.

Each of the mineral oil and synthetic oil can be employed singly. If desired, however, two or more mineral oils can be employed in combination, and two or more synthetic oils can be employed in combination. The mineral oil and synthetic oil can be employed in combination at an optional ratio.

Molybdenum-Containing Friction Modifier

The lubricating oil composition of the invention contains a molybdenum-containing friction modifier. The molybdenum-containing friction modifier can be any one of the known molybdenum-containing friction modifiers or the known molybdenum-containing friction modifier compositions. These friction modifiers and friction modifier compositions are described in the aforementioned Patent publications 1 to 3.

Preferred molybdenum-containing friction modifier is, for example, sulfurized oxymolybdenum dithiocarbamate, sulfurized oxymolybdenum dithiophosphate, amine-molybdenum complex compound, oxymolybdenum diethylate amide, and oxymolybdenum monoglyceride. Most preferred is a molybdenum dithiocarbamate friction modifier.

The lubricating oil composition of the invention generally contains the molybdenum-containing friction modifier in an amount of 0.01 to 0.15 wt. % in terms of the molybdenum content.

Overbased Metal-Containing Detergent

The lubricating oil composition of the invention contains a combination of the following overbased metal-containing detergents:

(a) calcium salicylate (specifically, monoalkylsalicylate) having an alkyl group having an average carbon atom number in the range of 14 to 18, at least 60 mol. % of said alkyl group having a carbon atom number in the range of 14 to 18; and (b) calcium sulfonate (specifically, monoalkylsulfonate) having an alkyl group having an average carbon atom number in the range of 20 to 24, at least 60 mol. % of said alkyl group having a carbon atom number in the range of 20 to 24, and/or calcium salicylate (specifically, monoalkylsalicylate) having an alkyl group having an average carbon atom number in the range of 20 to 28, at least 60 mol. % of said alkyl group having a carbon atom number in the range of 20 to 28.

Each of the above-mentioned components (b), namely, calcium sulfonate having an alkyl group having an average carbon atom number in the range of 20 to 24, at least 60 mol. % of said alkyl group having a carbon atom number in the range of 20 to 24, and calcium salicylate having an alkyl group having an average carbon atom number in the range of 20 to 28, at least 60 mol. % of said alkyl group having a carbon atom number in the range of 20 to 28 can be employed singly or in combination.

The above-mentioned component (a), namely, calcium salicylate having an alkyl group having an average carbon atom number in the range of 14 to 18, at least 60 mol. % of said alkyl group having a carbon atom number in the range of 14 to 18 preferably is a mixture comprising plural calcium salicylates having an alkyl group having an average carbon atom number in the range of 14 to 18 in an amount of 60 mol. % or more, particularly 70 mol. % or more.

One of the above-mentioned component (b), namely, calcium sulfonate having an alkyl group having an average carbon atom number in the range of 20 to 24, at least 60 mol. % of said alkyl group having a carbon atom number in the range of 20 to 24 preferably is a mixture comprising plural calcium sulfonates having an alkyl group having an average carbon atom number in the range of 20 to 24 in an amount of 60 mol. % or more, particularly 70 mol. % or more.

Another of the above-mentioned component (b), namely, calcium salicylate having an alkyl group having an average carbon atom number in the range of 20 to 28, at least 60 mol. % of said alkyl group having a carbon atom number in the range of 20 to 28 preferably is a mixture comprising plural calcium salicylates having an alkyl group having an average carbon atom number in the range of 20 to 28 in an amount of 60 mol. % or more, particularly 70 mol. % or more.

The lubricating oil composition contains each of the component (a) and component (b) generally in an amount of 0.01 to 0.4 wt. %, in terms of calcium content, based on the total amount of the lubricating oil composition.

It is preferred that the calcium salicylate of the component (a) is calcium salicylate having an overbased degree of 1 to 4, particularly 1.5 to 3. The calcium salicylate can be sulfurized or unsulfurized.

It is preferred that the calcium sulfonate and calcium salicylate of the component (b) are calcium sulfonate and calcium salicylate independently having an overbased degree of 6 to 24. Preferably, the calcium sulfonate has an overbased degree of 14 to 20, and the calcium salicylate has an overbased degree of 6 to 12.

The ratio of overbased degree for the component (b)/component (a) is preferably in the range of 2 to 12.

It is preferred that the lubricating oil composition of the invention further contains calcium sulfonate having an alkyl group having an average carbon atom number in the range of 14 to 24, at least 60 mol. % (preferably, at least 70 mol. %) of said alkyl group having a carbon atom number in the range of 14 to 24 and having an overbased degree of 0.1 to 2.

The lubricating oil composition of the invention can further contain relatively small amounts of other overbased or less overbased metal-containing detergents than the above-mentioned components (a) and (b). These metal-containing detergents may be salicylates, carboxylates, sulfonates and/or phenates.

Other Additives

The lubricating oil composition of the invention can further contain other lubricating oil additives. Examples of the other lubricating oil additives include nitrogen-containing ashless dispersants, zinc phosphate oxidation inhibitors (or zinc phosphate anti-wear agent) such as zinc dihydrocarbyldithiophosphate, and organic oxidation inhibitors (e.g., phenolic oxidation inhibitors and amine oxidation inhibitors).

The nitrogen-containing ashless dispersant preferably is an alkenyl- or alkyl-succinimide derived from polyolefin or a derivative thereof. The lubricating oil composition can contain the nitrogen-containing ashless dispersant in an amount of 0.01 to 0.3 wt. %, in terms of the nitrogen content, based on the amount of the lubricating oil composition. A representative succinimide can be prepared by the reaction between succinic anhydride substituted with a high molecular weight alkenyl or alkyl and a polyalkylene polyamine containing average 4 to 10 (preferably 5 to 7) nitrogen atoms in one molecule. The high molecular weight alkenyl or alkyl is preferably derived from polybutene having a number average molecular weight of about 900 to 3,000.

The process for obtaining the polybutenyl-succinic anhydride by the reaction of polybutene and maleic anhydride is generally performed by the chlorination process using a chloride compound. Otherwise, a thermal reaction process using no chlorine compound can be employed. It is preferred to employ a polybutenylsuccinimide which is derived from a polybutenylsuccinic anhydride by the thermal reaction process.

The succinimide can be a post-treated succinimide which is prepared by the reaction with boric acid, alcohol, aldehyde, ketone, alkylphenol, cyclic carbonate, organic acid or the like. Particularly, a borated alkenyl(or alkyl)-succinimide which is obtained by the reaction with a boroncontaining compound such as boric acid or a boron compound is advantageous from the viewpoints of thermal and oxidation stability.

The lubricating oil composition may contain other ashless dispersants such as an alkenylbenzylamine ashless dispersant and/or an alkenylsuccinic acid ester ashless dispersant in addition to or in place of the above-mentioned alkenyl(or alkyl)-succinimide ashless dispersant.

The lubricating oil composition may contain a zinc phosphate oxidation inhibitor (or zinc phosphate anti-ware agent). The zinc phosphate oxidation inhibitor (or zinc phosphate anti-ware agent) may be selected from the group consisting of zinc dialkyldithiophosphate, zinc dialkylmonothiophosphate and zinc dihydrocarbylphosphate). The zinc phosphate oxidation inhibitors/anti-wear agents are well known with respect to their preparation processes and natures. The zinc phosphate oxidation inhibitors/anti-wear agents are generally contained in an amount of 0.01 to 0.12 wt. %, in terms of the phosphorus content, based on the amount of the lubricating oil composition. However, the amount preferably is in the range of 0.01 to 0.06 wt. %, in consideration of the preparation of a low-phosphorus, low-sulfur lubricating oil composition.

The zinc dialkyldithiophosphate preferably contains an alkyl group having 3-18 carbon atoms or an alkylaryl group having $C_{3-18}$ alkyl group. Most preferred is a zinc dialkyldithiophosphate containing an alkyl group derived from a secondary alcohol having 3-18 carbon atoms or a zinc dialkyldithiophosphate containing a mixture of alkyl groups derived from a mixture of a primary alcohol having 3-18 carbon atoms and a secondary alcohol having 3-18 carbon atoms. Both are particularly effective for reducing wear. A zinc dialkyldithiophosphate derived from a primary alcohol shows high thermal resistance. These zinc dialkyldithiophosphates can be employed alone or in combination in the form of a mixture mainly comprising one derived from the secondary alcohol and/or one derived from the primary alcohol.

The lubricating oil composition of the invention preferably contains an organic oxidation inhibitor in an amount of 0.01-5 wt. %, preferably 0.1-3 wt. %. The oxidation inhibitor can be a hindered phenol oxidation inhibitor or a diarylamine oxidation inhibitor. The diarylamine oxidation inhibitor is advantageous in giving a base number originating from the nitrogen atoms. The hindered phenol oxidation inhibitor is advantageous in producing no $NO_x$ gas.

Examples of the hindered phenol oxidation inhibitors include 2,6-di-t-butyl-p-cresol, 4,4'-methylenebis(2,6-di-t-butylphenol), 4,4'-methylenebis(6-t-butyl-o-cresol), 4,4'-isopropylidenebis(2,6-di-t-butylphenol), 4,4'-bis(2,6-di-t-butylphenol), 2,2'-methylenebis(4-methyl-6-t-butylphenol), 4,4'-thiobis(2-methyl-6-t-butylphenol), 2,2-thio-diethylenebis[3-(3,5-di-t-butyl-4-hydroxyphenyl)propionate], octyl 3-(3,5-di-t-butyl-4-hydroxyphenyl)propionate, octadecyl 3-(3,5-di-t-butyl-4-hydroxyphenyl)propionate, and octyl 3-(3,54-butyl-4-hydroxy-3-methylphenyl)propionate.

Examples of the diarylamine oxidation inhibitors include alkyldiphenylamine having a mixture of alkyl groups of 4 to 9 carbon atoms, p,p'-dioctyldiphenylamine, phenyl-naphthylamine, phenyl-naphthylamine, alkylated-naphthylamine, and alkylated phenyl-naphthylamine.

Each of the hindered phenol oxidation inhibitor and diarylamine oxidation inhibitor can be employed alone or in combination. If desired, other oil soluble oxidation inhibitors can be employed in combination with the above-mentioned oxidation inhibitor(s).

The lubricating oil composition of the invention may further contain an oxymolybdenum complex of succinimide, particularly a sulfur-containing oxymolybdenum complex of succinimide. The sulfur-containing oxymolybdenum complex of succinimide can provide increased oxidation inhibition when it is employed in combination with the above-mentioned phenolic or amine oxidation inhibitors.

The lubricating oil composition of the invention may further contain an alkali metal borate hydrate in an amount of 5 wt. % or less, particularly in an amount of 0.01 to 5 wt. %. A representative alkali metal borate hydrate can be prepared in the manner described in U.S. Pat. Nos. 3,929,650 and 4,089,790. For example, the alkali metal borate hydrate can be in the form of a dispersion containing micro-particles of an alkali metal borate hydrate which is produced by carbonizing a neutral alkali metal or alkaline earth metal sulfonate in the presence of an alkali metal hydroxide to yield an overbased sulfonate and reacting the overbased sulfonate with boric acid. In the carbonizing procedure, it is desired to incorporate an ashless dispersant such as succinimide into the reaction mixture. The alkali metal preferably is potassium or sodium. The alkali metal borate hydrate can be a dispersion of $KB_3O_5H_2O$ particles having a particle size of about 0.3 m or less which is dispersed in the presence of a neutral calcium sulfonate and succinimide.

The lubricating oil composition of the invention preferably contains a viscosity index improver in an amount of 20 wt. % or less, preferably 1 to 20 wt. %. Examples of the viscosity index improvers are polymers such as polyalkyl methacrylate, ethylene-propylene copolymer, styrene-butadiene copolymer, and polyisoprene. A dispersant viscosity index improver and a multi-functional viscosity index improver which are produced by providing dispersing properties to the above-mentioned polymer are preferably employed. The viscosity index improvers can be used alone or in combination.

The lubricating oil composition of the invention may further contain a small amount of various auxiliary additives. Examples of the auxiliary additives are described below.

Oxidation inhibitor or anti-wear agent such as zinc dithiocarbamate, methylenebis(dibutyldithiocarbamate), oil soluble copper compounds, sulfur-containing compounds (e.g., sulfurized olefins, sulfurized esters, and polysulfide), phosphoric acid esters, phosphorous acid esters, thiophosphoric acid esters, and organic amide compounds (e.g., oleylamide); benzotriazol compounds and thiadiazol compounds functioning as metal deactivating agent; and nonionic polyoxyalkylene surface active agents such as polyoxyethylene-alkylphenyl ether and copolymers of ethylene oxide and propylene oxide functioning as an anti-rust agent and an anti-emulsifying agent.

Further, various amines, amides, amine salts and their derivatives which can function as friction modifiers can be employed.

Furthermore, various compounds functioning as an anti-foaming agent and a pour point depressant can be incorporated.

The above-mentioned auxiliary additives may be incorporated into the lubricating oil composition in an amount of 3 wt. % or less, particularly in an amount of 0.001-3 wt. %.

Examples [1-3], and Comparative Examples [1-3]

(1) Preparation of Lubricating Oil Compositions (Test Oils)

Lubricating oil compositions were prepared by adding the below-mentioned additive components to the base oil to give the formulations set forth in Table 1. The lubricating oil compositions of Examples 1 to 3 are according to the invention, while the lubricating oil compositions of Comparative Examples 1 to 3 are for comparison. The lubricating oil compositions were formulated to show a viscosity grade (SAE viscosity grade) of 0W20 and a kinematic viscosity of 7.7-7.8 $mm^2/s$ at 100° C., by addition of a viscosity index improver.

(2) Base Oil and Additives (I) Base Oil:

Mineral base oil (kinematic viscosity at 100° C.: 4.1 $mm^2/s$, viscosity index: 137) prepared from slack wax via hydrogenation, fractional distillation and dewaxing.

(II) Additives

Nitrogen-Containing Ashless Dispersant

Ethylene carbonate post-treated succinimide dispersant (bis-type, nitrogen content: 1.0 wt. %) derived from polybutene (number average molecular weight: about 2,300).

Metal-Containing Detergent a) Overbased Ca salicylate (1)[Ca-sali-1]: Calcium monoalkylsalicylate having alkyl groups in which approx. 80 mol. % of the whole alkyl groups were $C_{14-18}$ alkyl groups (Ca: 6.1 wt. %, S: 0.1 wt. %, TBN: 170 mg KOH/g, overbased degree: 2.3)

b) Overbased Ca sulfonate [Ca-sulf-1]: Calcium alkyltoluenesulfonate having alkyl groups in which approx. 80 mol. % of the whole alkyl groups were $C_{20-24}$ alkyl groups (Ca: 16.0 wt. %, S: 1.6 wt. %, TBN: 423 mg KOH/g, overbased degree: 17)

c) Overbased Ca salicylate (2)[Ca-sali-2]: Calcium monoalkylsalicylate having alkyl groups in which approx. 80 mol. % of the whole alkyl groups were $C_{20-28}$ alkyl groups (Ca: 11.4 wt. %, S: 0.2 wt. %, TBN: 320 mg KOH/g, overbased degree: 8.2)

d) Low overbased Ca sulfonate [Ca-sulf-2]: Calcium alkylbenzenesulfonate having alkyl groups in which approx. 80 mol. % of the whole alkyl groups were $C_{14-24}$ alkyl groups (Ca: 2.4 wt. %, S: 2.9 wt. %, TBN: 17 mg KOH/g, overbased degree: 0.34)

Molybdenum-Containing Friction Modifier

Sulfurized oxymolybdenum dithiocarbamate (Mo-DTC, Mo: 10 wt. %, S: 11 wt. %)

Zinc Phosphate Oxidation Inhibitor

Zinc di(secondary alkyl)dithiophosphate (ZnDTP-1, P: 7.8 wt. %, Zn: 7.8 wt. %, S: 14 wt. %)

Zinc di(primary alkyl)dithiophosphate (ZnDTP-2, P: 7.3 wt. %, Zn: 8.4 wt. %, S: 14 wt. %)

Organic Oxidation Inhibitor (Ox. Inhi.

Amine oxidation inhibitor: dialkyldiphenylamine

Sulfur-Containing Succinimide-Molybdenum Complex (Mo Comp.)

Mo-containing complex (Mo: 5.5 wt. %, S: 0.2 wt. %, N, 1.6 wt. %, TBN: 10 mg KOH/g)

Viscosity Index Improver

Polymethacrylate viscosity index improver (3) Evaluation of Lubricating Oil Compositions a) Test Method The crank shaft of a gasoline engine (in-line 4 cylinder engine, engine swept volume: 1.8 L, roller type-valve system) was rotated by means of an electric motor connected via a torque meter, and the running torque was monitored. In advance of starting the test, the ignition plug was removed so as to minimize the effect caused by pumping loss of the pistons, and the test was carried out under open conditions. The oil temperature was kept to 100° C. The test was carried out at respective rotational rates for 150 seconds. The torques were continuously monitored during the period from the time at a lapse of 30 sec. from the beginning of the test to 120 sec. An average torque value was calculated from the monitored torque values.

Independently, a reference oil (SAE viscosity grade: 0W20, kinematic viscosity at 100° C.: 8.9 $mm^2/s$) was prepared.

From the torque value and the above-mentioned average torque value of the tested oil, a torque reduction ratio (%) was calculated. The torque reduction ratio is set forth in Table 1.

b) Test Results

The test results of the test oils are set forth in Table 1 below.

TABLE 1

| Additives | Ex. 1 | Ex. 2 | Ex. 3 | Com. 1 | Com. 2 | Com. 3 |
|---|---|---|---|---|---|---|
| Ashless | | | | | | |
| Dispersant | 0.03 | 0.03 | 0.03 | 0.03 | 0.03 | 0.03 |
| Ca-sali-1 | 0.12 | 0.06 | 0.12 | 0.18 | — | — |
| Ca-sul-1 | 0.06 | 0.12 | — | — | 0.18 | — |
| Ca-sali-2 | — | — | 0.06 | — | — | 0.18 |
| Ca-sul-2 | 0.02 | 0.02 | 0.02 | 0.02 | 0.02 | 0.02 |
| Mo-DTC | 0.07 | 0.07 | 0.07 | 0.07 | 0.07 | 0.07 |
| ZnDTP-1 | 0.03 | 0.03 | 0.03 | 0.03 | 0.03 | 0.03 |
| ZnDTP-2 | 0.05 | 0.05 | 0.05 | 0.05 | 0.05 | 0.05 |
| Ox. inhi. | 1.2 | 1.2 | 1.2 | 1.2 | 1.2 | 1.2 |
| Mo. comp. | 0.4 | 0.4 | 0.4 | 0.4 | 0.4 | 0.4 |
| Test results Torque reduction ratio (%) | | | | | | |
| 550 rpm | 6.2 | 5.9 | 6.0 | 5.5 | 5.3 | 5.7 |
| 950 rpm | 4.2 | 4.2 | 3.9 | 3.5 | 3.7 | 3.6 |
| 1500 rpm | 2.0 | 2.2 | 2.0 | 1.6 | 1.9 | 1.3 |

In Table 1, Ex. = Example; Com. = Comparative Example

Remarks:

The amounts of the additives are indicated as follows:

Ox.inhi. (i.e., organic oxidation inhibitor) and Mo.comp. (i.e., sulfur-containing succinimide-molybdenum complex) are set forth in terms of the amount (wt. %) of the additive per se;

Ashless additive, calcium-containing detergents (Ca-sali-1, Ca-sul-1, Ca-sali-2, Ca-sul-2), Mo-DTC, and Zinc-containing compounds (ZnDTP-1, ZnDTP-2) are set forth in terms of N content (wt. %), Ca content (wt. %), Mo content (wt. %), and P content (wt. %), respectively.

The test results set forth in Table 1 indicate that the lubricating oil composition according to the invention (Examples 1 to 3) show extremely high torque reduction as compared with the lubricating oil compositions (Comparison Examples 1 to 3) containing metal-containing detergents differing from those contained in the lubrication oil compositions of Examples 1 to 3.

What is claimed is:

1. A lubricating oil composition for internal combustion engines which comprises a major amount of an oil of lubricating viscosity and a minor amount of an additive composition comprising an overbased metal-containing detergent composition and a molybdenum-containing friction modifier;

wherein the overbased metal-containing detergent composition comprises a calcium salicylate having an overbased degree of 1 to 4 and having an alkyl group having an average carbon atom number in the range of 14 to 18, at least 60 mol. % of said alkyl group having a carbon atom number in the range of 14 to 18; and one or more calcium-containing detergents selected from the group consisting of:

a calcium sulfonate having an overbased degree of 6 to 24 and having an alkyl group having an average carbon atom number in the range of 20 to 24, at least 60 mol. % of said alkyl group having a carbon atom number in the range of 20 to 24; and a calcium salicylate having an overbased degree of 6 to 24 and having an alkyl group having an average carbon atom number in the range of 20 to 28, at least 60 mol. % of said alkyl group having a carbon atom number in the range of 20 to 28;

wherein the lubricating oil composition further comprises a low overbased calcium sulfonate having an alkyl group having an average carbon atom number in the range of 14 to 24, at least 60 mol. % of said alkyl group having a carbon atom number in the range of 14 to 24 and having an overbased degree of 0.1 to 2.

2. The lubricating oil composition of claim 1, wherein the molybdenum-containing friction modifier comprises molybdenum dithiocarbamate.

3. The lubricating oil composition of claim 1, wherein the one or more calcium-containing detergents is the calcium sulfonate having an overbased degree of 6 to 24 and the ratio of the overbased degree of the calcium sulfonate having an overbased degree of 6 to 24 to the calcium salicylate having an overbased degree of 1 to 4 is an overbased degree ratio in the range of 2 to 12.

4. The lubricating oil composition of claim 1, wherein the overbased metal-containing detergent comprises the calcium salicylate having an overbased degree of 1 to 4 and having an alkyl group having an average carbon atom number in the range of 14 to 18, at least 60 mol. % of said alkyl group having a carbon atom number in the range of 14 to 18 and wherein the one or more calcium-containing detergents is the calcium sulfonate having an overbased degree of 6 to 24 and having an alkyl group having an average carbon atom number in the range of 20 to 24, at least 60 mol. % of said alkyl group having a carbon atom number in the range of 20 to 24.

5. The lubricating oil composition of claim 1, wherein the overbased metal-containing detergent composition comprises the calcium salicylate having an overbased degree of 1 to 4 and having an alkyl group having an average carbon atom number in the range of 14 to 18, at least 60 mol. % of said alkyl group having a carbon atom number in the range of 14 to 18 and wherein the one or more calcium-containing detergents is the calcium salicylate having an overbased degree of 6 to 24 and having an alkyl group having an average carbon atom number in the range of 20 to 28, at least 60 mol. % of said alkyl group having a carbon atom number in the range of 20 to 28.

6. The lubricating oil composition of claim 1, which comprises the molybdenum-containing friction modifier in an amount of 0.01 to 0.15 wt. % in terms of molybdenum content in the lubricating oil composition.

7. The lubricating oil composition of claim 1, wherein the one or more calcium-containing detergents is the calcium sulfonate having an overbased degree of 6 to 24 and the lubricating oil composition comprises each of the calcium salicylate having an overbased degree of 1 to 4 and having an alkyl group having an average carbon atom number in the range of 14 to 18, at least 60 mol. % of said alkyl group having a carbon atom number in the range of 14 to 18 and the calcium sulfonate having an overbased degree of 6 to 24 and having an alkyl group having an average carbon atom number in the range of 20 to 24, at least 60 mol. % of said alkyl group having a carbon atom number in the range of 20 to 24 in an amount of 0.01 to 0.4 wt. % in terms of calcium content in the lubricating oil composition.

8. The lubricating oil composition of claim 1, which further comprises a lubricating oil additive selected from the group consisting of a nitrogen-containing ashless dispersant, a zinc phosphate oxidation inhibitor, a zinc phosphate wear inhibitor, a phenolic oxidation inhibitor, and an amine oxidation inhibitor.

9. The lubricating oil composition of claim 8, wherein each of the zinc phosphate oxidation inhibitor and zinc phosphate wear inhibitor comprises a mixture of zinc di(primary alkyl) dithiophosphate and zinc di(secondary alkyl)dithiophosphate in a weight ratio of 1/9 to 9/1.

10. The lubricating oil composition of claim 8, wherein the nitrogen-containing ashless dispersant is a succinimide dispersant or a succinimide dispersant which is post-treated with ethylene carbonate or a borate compound.

11. The lubricating oil composition of claim 1, which further comprises a molybdenum complex of a succinimide or a sulfur-containing succinimide-molybdenum complex.

12. The lubricating oil composition of claim 1, wherein the oil of lubricating viscosity has a viscosity index of 120 to 160.

13. The lubricating oil composition of claim 1, which satisfies SAE viscosity grade of 0W20.

14. The lubricating oil composition of claim 1, wherein the one or more calcium-containing detergents is the calcium salicylate having an overbased degree of 6 to 24 and the ratio of the overbased degree of the calcium salicylate having an overbased degree of 1 to 4 to the calcium salicylate having an overbased degree of 6 to 24 is an overbased degree ratio in the range of 2 to 12.

15. The lubricating oil composition of claim 1, wherein the one or more calcium-containing detergents is the calcium salicylate having an overbased degree of 6 to 24 and the lubricating oil composition comprises each of the calcium salicylate having an overbased degree of 1 to 4 and having an alkyl group having an average carbon atom number in the range of 14 to 18, at least 60 mol. % of said alkyl group having a carbon atom number in the range of 14 to 18 and the calcium salicylate having an overbased degree of 6 to 24 and having an alkyl group having an average carbon atom number in the range of 20 to 28, at least 60 mol. % of said alkyl group having a carbon atom number in the range of 20 to 28 in an amount of 0.01 to 0.4 wt. % in terms of calcium content in the lubricating oil composition.

* * * * *